United States Patent [19]

Fillmore et al.

[11] 4,168,128

[45] Sep. 18, 1979

[54] SEAL ROLLER DISPENSING PACKAGE

[75] Inventors: William E. Fillmore; George V. Mumford, both of Toledo, Ohio

[73] Assignee: Owens-Illinois, Inc., Toledo, Ohio

[21] Appl. No.: 853,163

[22] Filed: Nov. 21, 1977

[51] Int. Cl.[2] ..... B05C 17/02

[52] U.S. Cl. ..... 401/213; 222/513; 222/562; 401/216

[58] Field of Search ..... 401/208-220; 222/212, 181, 513, 562, 565

[56] References Cited

U.S. PATENT DOCUMENTS

| | | | |
|---|---|---|---|
| 2,807,817 | 10/1957 | Ackerman | 401/213 |
| 2,910,712 | 11/1959 | Schaich et al. | 401/213 |
| 2,998,616 | 9/1961 | Gentile | 401/213 |
| 3,039,132 | 6/1962 | Hambley | 401/220 |
| 3,075,230 | 1/1963 | Marchant | 401/220 |
| 3,090,987 | 5/1963 | Ruekberg | 401/213 |
| 3,174,175 | 3/1965 | Frank | 401/213 |
| 3,349,975 | 10/1967 | Damron | 222/542 |
| 3,410,460 | 11/1968 | Musher | 222/562 |
| 4,002,411 | 1/1977 | Harbauer | 401/213 |

FOREIGN PATENT DOCUMENTS

| | | | |
|---|---|---|---|
| 432739 | 9/1967 | Switzerland | 401/213 |

*Primary Examiner*—Clyde I. Coughenour

*Attorney, Agent, or Firm*—John R. Nelson; Myron E. Click; David H. Wilson

[57] ABSTRACT

An improved dual-seal, wide-surface roller-type dispensing package combination for cosmetics and the like. A wide-surface dispensing roller is held in place in a fitment which is adapted to be attached to the finish portion of a container for the product to be dispensed. The dispensing roller is allowed to revolve within the fitment to facilitate uniform dispensing and application of the contents of the container. The total package is completed by a closure which is adapted to snap into engagement with the container. A primary seal is formed between the dispensing roller and the fitment upon application of the closure. The closure also includes a quantity of resilient material, such as a foamed polymer, positioned to contact the dispensing roller and the fitment to form a secondary seal to prevent leakage of product when the closure is placed into engagement with the container.

1 Claim, 4 Drawing Figures

SEAL ROLLER DISPENSING PACKAGE

BACKGROUND OF THE INVENTION

This invention generally relates to ball or roller-type applicators for cometics and the like. More specifically, this invention relates to a complete rollertype applicator package including a closure, a fitment, a wide-surface dispensing roller and a container for the product to be dispensed. Particularly, this invention relates to an improved package wherein the closure incorporates a quantity of resilient material, such as a foamed polymer, positioned to contact the dispensing roller and the fitment to form an improved seal to prevent leakage of product when the closure is placed into engagement with the container.

The ball-type applicator is well known in the art for dispensing of cosmetics of various types, particularly liquid deodorants and perfumes. Examples of pertinent prior art patents include U.S. Pat. Nos. 2,975,466 and 4,002,411. Each of these patents teaches the general combination of a closure, fitment and ball as applied to the finish portion of a container neck. However, in each of these patents only a single seal is provided between the fitment and the dispensing ball upon application of the closure to the container. Thus, there is always the possibility of leakage of product from the container during shipping and storage of the assembled package. For example, if the fitment should become distorted or stressed, such a single seal could fail and result in leakage. Furthermore, drying of the product on the ball may occur which impedes rotation of the ball or roller. In addition, utilization of a non-spherical or wide-surface roller in place of a spherical ball creates additional sealing problems. Furthermore, if the package is to be utilized for dispensing powder type cosmetics the required clearance between the roller and the fitment complicates the problem of sealing the container upon application of the closure of the container.

SUMMARY OF THE INVENTION

It is, therefore, an object of this invention to overcome the disadvantages associated with the prior art ball or roller type dispensing packages by providing an improved dual-seal package of this type.

The improved package of this invention incorporates dual seals when the closure is placed in the fully engaged position with the container to prevent leakage of product. In the design of this invention, a wide-surface dispensing roller is held in place in a fitment which is adapted to be attached to the finish portion of a container for the product to be dispensed. The fitment is formed of a resilient material and includes a roller-retaining socket, which is shaped to cover the open mouth of the container and generally surrounds and retains the dispensing roller. The roller-retaining socket incorporates at least one aperture which overlies the open mouth of the container for dispensing the contents of the container. The fitment also incorporates a downwardly extending container-engaging flange portion with an inwardly directed bead which is adapted to engage a mating retaining bead on the container neck to secure the fitment to the container. The fitment also incorporates a stabilized skirt portion around its periphery which also extends downwardly into engagement with the container. The wide-surface dispensing roller is positioned within the retaining socket of the fitment so as to be in communication with the dispensing apertures to receive product from within the container. A closure member is provided and is adapted to be snapped into mating engagement with the container. A primary seal is formed between the dispensing roller and the fitment in the area of the dispensing aperture, upon application of the closure to the container. The closure also incorporates a quantity of resilient material on its inner surface which is positioned to contact the dispensing roller and the fitment to provide a secondary seal.

Other objects, features and advantages of the subject invention will become apparent upon reference to the following detailed description of the invention and the drawings illustrating the preferred embodiments thereof.

IN THE DRAWINGS

DETAILED DESCRIPTION OF THE PREFERRED EMBODIMENTS

Figure 1:
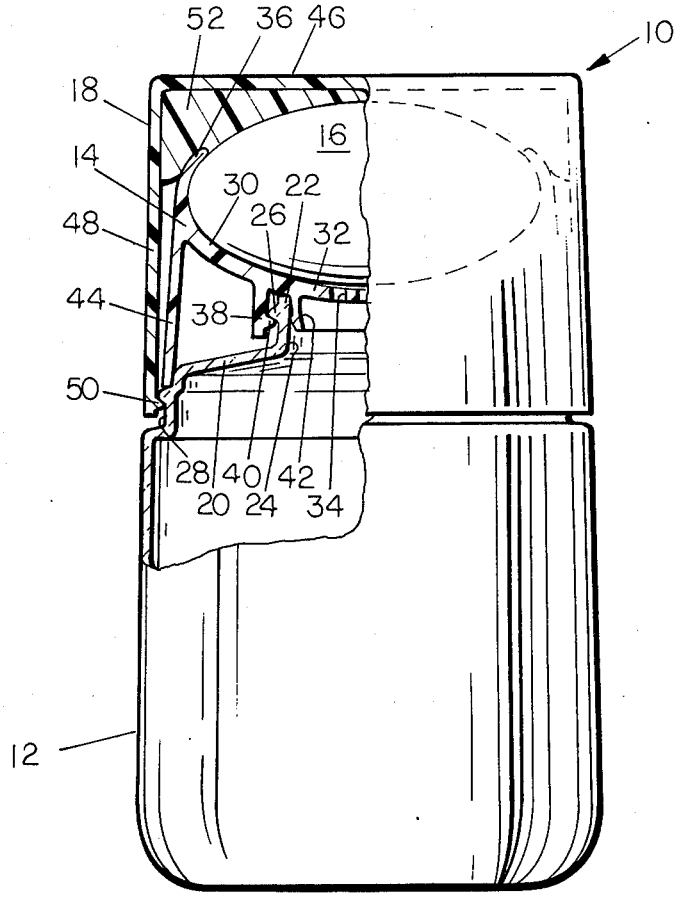
FIG. 1 is a front elevational view, with parts broken away in section, of a unique roller-type dispensing package incorporating the features of this invention.

Referring now to the drawings, FIG. 1 illustrates the unique dual seal roller-type dispensing package of this invention which is indicated generally by the numeral 10. The package 10 includes a container 12 for the product to be dispensed, a roller-retaining fitment 14, which is snapped into engagement with the container 12, a wide-surface dispensing roller 16, which is rotatably retained within the fitment 14, and a closure member 18 which encloses the fitment 14 and roller 16 and snaps into engagement with the container 12. The container 12 includes a neck portion 20 which terminates at its upper extremity in an annular rim 22 which defines the periphery of an open mouth 24 through which the product held within the container 12 may be dispensed. The container neck 20 includes a retaining bead 26 adjacent to the annular rim 22 on the outer surface thereof which is adapted for the retention of the fitment 14. A circumferential groove 28 is positioned near the outer extremity of the container neck 20 and is adapted for retention of the closure member 18. The remaining portion of the container 12 may be of any suitable aesthetically appealing, closed configuration for containing a cosmetic or the like.

The roller-retaining fitment 14 may be formed of a resilient material and includes a generally arcuate roller retaining socket 30 which includes a bottom diaphragm portion 32 having apertures 34 formed therethrough and upwardly extending lip portion 36. The fitment 14 includes a downwardly extending container-engaging flange 38 which incorporates a retaining bead 40 which is adapted to matingly engage with the retaining bead 26 on the container neck 20 to secure the fitment 14 into engagement with the container 12. A plug-type sealing member 42 also extends downwardly from the fitment 14 to engage the interior surface of the open mouth 24 of the container neck 20. A stabilizing skirt portion 44 extends downwardly from the outer periphery of the fitment 14 and rests against the container neck 20 just above the circumferential groove 28 to provide additional stability for the fitment 14 and dispensing roller 16 held therein. The fitment 14 is sized and shaped so that the roller 16 is held within the roller-retaining socket 30 and is forced into sealing engagement with the bottom diaphragm portion 32 upon the application of the closure 18 to the container 12. In the absence of the closure member 18, the roller 16 must be permitted to revolve within the fitment 14 and must have a minor portion thereof extending beyond the lip portion 36 of the fitment for purposes of applying the product being dispensed.

The closure member 18 includes a generally flat top panel 46 and a skirt portion 48 which extends downwardly from the outer periphery of the top panel 46. The interior surface of the skirt 48 incorporates a retaining bead 50 adjacent its lower extremity which is adapted to engage with the circumferential groove 28 on the container neck 20 to hold the closure 18 in engagement with the container 12.

Figure 2:
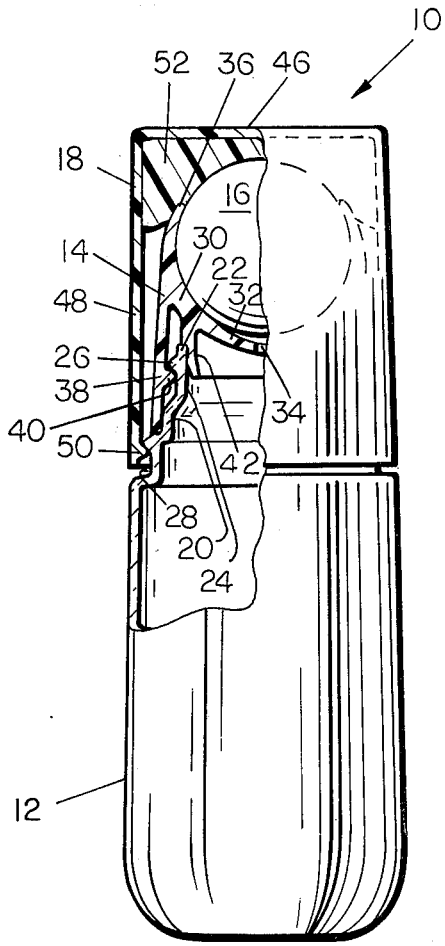
FIG. 2 is a side elevational view, with parts broken away in section, of the package of FIG. 1.

In the embodiment shown in FIGS. 1 and 2, the closure member 18 includes a quantity of resilient sealing material 52 positioned across the interior of the top panel 46 and adjacent the interior of the upper portion of the skirt 48. This resilient sealing material 52 is positioned so that it is adapted to engage the upper surface of the roller 16 and the lip portion 36 of the fitment 14 to provide a complete seal to prevent leakage of product upon application of the closure 18 to the container 12. It should be noted that upon application of the closure 18 to the container 12 the resilient material 52 contacts the roller 16 and the fitment 14 to force these members into contact with each other in the area of the diaphragm portion 32 to create a primary seal between the roller 16 and the fitment 14. In addition, the resilient material 52 creates a secondary seal between the roller 16, fitment 14 and the closure 18 upon application of the closure 18 to the container 12.

Thus, from the preceding description, it can be seen that the unique package of this invention provides a dual seal for the prevention of leakage of product from the package. Through the use of the layer of resilient material, the utilization of wide-surface non-spherical roller-type applicators is facilitated for dispensing cosmetics and the like. As mentioned previously, non-spherical rollers provide a much broader application surface than do spherical applicators. However, the non-spherical, wide-surface rollers also provide an increased opportunity for leakage between the roller and the retaining fitment. Therefore, the unique utilization of a foamed sealing system on the interior of the closure of this invention solves the aforementioned sealing difficulties relating to the use of a wide-surface roller applicator. The resilient material 52 may consist of any of a number of suitable such materials. However, it is suggested that it comprise one of the foamed polymers, such as polyethylene foam or polyurethane foam, which are both light in weight and effective as a sealing material.

Figure 3:
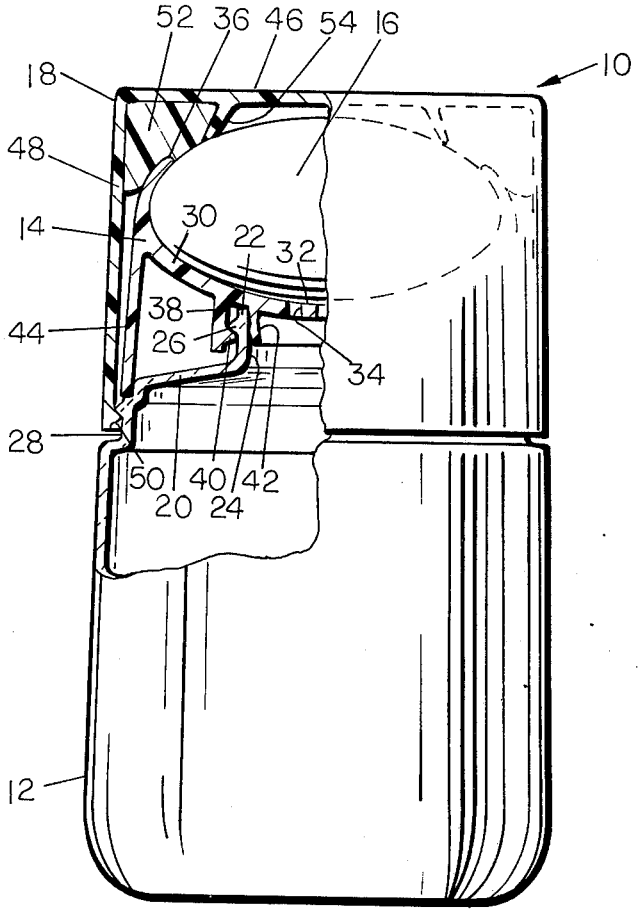
FIG. 3 is a front elevational view, with parts broken away in section, of an alternate embodiment of unique roller-type dispensing package of this invention.
Figure 4:
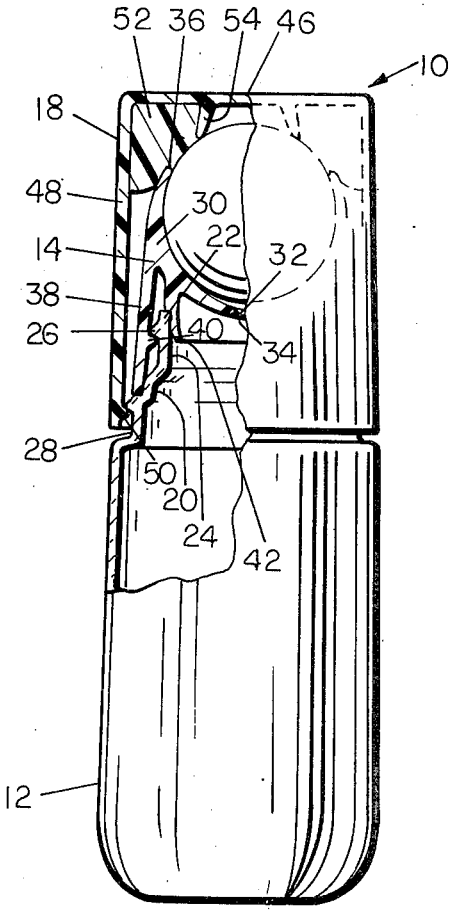
FIG. 4 is a side elevational view, with parts broken away in section, of the FIG. 3 embodiment.

The embodiment shown in FIGS. 3 and 4 is identical to that shown in FIGS. 1 and 2 with the exception that the top panel 46 of the closure 18 incorporates a downwardly extending roller-contacting bead 54 which provides a more positive force against the roller 16 for creation of a primary seal between the roller 16 and the fitment 14 in the area of the diaphragm portion 32. In this embodiment the foamed material 52 completely fills the corner of the interior of the closure 18 and extends inwardly to the downwardly extending bead 54. However, the foamed material does not extend across the entire upper surface of the roller 16 as it does in the FIGS. 1 and 2 embodiment. The embodiment of FIGS. 3 and 4 utilizing the bead 54 may have advantages over that of FIGS. 1 and 2 when it is desired to utilize a relatively large package wherein the additional downward force impressed upon the roller by the bead 54 would be more likely to create the primary seal between the roller 16 and the fitment 14. In addition, the embodiment of FIGS. 3 and 4 requires a smaller quantity of the foamed material than does the embodiment of FIGS. 1 and 2.

We claim:

1. An improved, dual-seal, roller-applicator dispensing package comprising, in combination:

a container having a neck portion defining an opening at one end thereof for dispensing the contents thereof, said neck portion including first and second interference fit means on its outer surface;

a roller-retaining fitment having a generally arcuate roller-retaining socket covering the opening of said container neck and including at least one aperture for dispensing the contents of said container and an upwardly extending lip portion, and a container-engaging flange extending downwardly from said roller-retaining socket and including a container-engaging interference fit means on its inner surface for engagement with said first interference fit means on said container neck;

a dispensing roller having a major portion inserted within said roller-retaining socket of said fitment so as to be in communication with said dispensing aperture and having a minor portion extending beyond the extremity of said roller-retaining socket to define a dispensing surface; and a closure member including a top panel and a skirt portion depending from the periphery of the top panel and having a container-engaging interference fit means on its inner surface for engagement with said second interference fit means on the neck of the container, said closure member including inwardly directed means on the interior of said top panel which contacts said dispensing roller to force said dispensing roller into sealing engagement with said fitment, and a quantity of resilient foamed polymer material positioned on the interior surface of the top panel radially outwardly from said inwardly directed means on the interior of said top panel and on a portion of the interior surface of the skirt portion to contact the dispensing roller and the lip portion of said fitment to create a seal therebetween and to bias said dispensing roller into sealing engagement with said fitment to thereby create a double seal between the dispensing roller and the fitment.

* * * * *